United States Patent [19]

Edwardsen et al.

[11] 4,444,555

[45] Apr. 24, 1984

[54] METHOD FOR REDUCING STRESS CORROSION CRACKING IN HIGH-TEMPERATURE REGENERATIVE AIR HEATERS

[75] Inventors: Horace B. Edwardsen, Pittsburgh; Donald J. Shellenberger, Bethel Park, both of Pa.

[73] Assignee: Koppers Company, Inc., Pittsburgh, Pa.

[21] Appl. No.: 371,977

[22] Filed: Apr. 26, 1982

[51] Int. Cl.[3] ..... F24H 7/00; C21B 13/00

[52] U.S. Cl. ..... 432/30; 266/44

[58] Field of Search ..... 432/26, 29, 30, 214, 432/216, 217, 218, 54; 266/44

[56] References Cited

U.S. PATENT DOCUMENTS 3,746,503 7/1973 Miyashita et al. ..... 432/30

4,022,573 5/1977 Kuntziger ..... 432/216

*Primary Examiner*—John J. Camby

*Attorney, Agent, or Firm*—J. Timothy Keane; Daniel J. Long; Herbert J. Zeh, Jr.

[57] ABSTRACT

Stress corrosion cracking which occurs in metallic portions of a high-temperature regenerative air heater can be alleviated by the disclosed methods. The methods include the step of storing a gas charge within a heated regenerative air heater, which gas charge is substantially devoid of free oxygen. The substantial absence of free oxygen from the gas charge prevents or reduces formation of nitrogen-containing oxides which typically form within an air-containing gas charge stored in a regenerative air heater held at high temperature. Conditions conducive to stress corrosion cracking are thereby alleviated by reduction of these nitrogen-containing oxides which are precursors to corrosive acids. The methods are particularly suitable for reducing stress corrosion cracking in blast furnace stoves.

23 Claims, 2 Drawing Figures

METHOD FOR REDUCING STRESS CORROSION CRACKING IN HIGH-TEMPERATURE REGENERATIVE AIR HEATERS

BACKGROUND OF THE INVENTION

1. Field

A high-temperature regenerative air heater transfers heat from a heat-surrendering combustion product or waste gas stream to a heat-absorbing air stream by alternate exposure of these streams of gas and air to heat-transfer members within the regenerative air heater. Of particular interest herein are methods for reducing stress corrosion cracking which occurs in metallic portions of a high-temperature regenerative air heater.

2. State of the Art

One example of a high-temperature regenerative air heater is a blast furnace stove. In a typical blast furnace iron-making operation, a furnace containing a charge of iron-bearing material, coke and flux is provided with a current of heated air, or "blast", which burns the coke. Hot blast air is usually obtained by heating air in a blast furnace stove, three or more of which are usually connected in a parallel arrangement. Blast air is provided by a blast furnace stove which at times operates in a three-phase cycle. In a first, or "on-gas" phase, the stove is heated by burning a combustible mixture of gases within the stove. In a second, or "stand-by", or "bottled" condition phase, the heated stove is held ready to deliver up its stored heat to an incoming air stream. In a third, or "on-blast" phase, the stove delivers up its stored heat to an air stream, which when heated by the stove, provides blast to a blast furnace.

During the heating phase of blast furnace stove operation, blast furnace top gas, which has been cleaned and then enriched with coke oven gas, natural gas, or other enriching fuel, to increase its BTu content, enters the stove combustion chamber together with air and is combusted. Products of combustion then pass through the stove heat exchanger, or checkerwork, and deliver up heat to the checkerwork, and thereafter exhaust to the atmosphere. During a typical heating of 45 to 90 minutes, certain portions of the stove, such as the combustion chamber, dome and top checkers, reach temperatures of about 1400° C. or higher. After the stove reaches its fully-heated condition, the flow of combustible gases to the combustion chamber is shut off, followed thereafter by shut off of the combustion air. If the stove is not immediately placed in the "on-blast" phase after shutting off the gas flow, the stove is usually maintained in a stand-by or bottled condition with gases bottled in the stove at about atmospheric pressure. A bottled stove may be on stand-by for 20 minutes to one hour, although stand-by periods of much greater duration are not uncommon when furnace operation is delayed.

During cyclic operation of a blast furnace stove, temperatures of various interior portions of the stove may vary from ambient to above 1400° C. These wide variations in temperature subject the stove walls and linings and other interior parts to repeated stresses. Stove walls are particularly susceptible to stress inasmuch as very high temperature gradients are created within wall portions, with the interior refractory lining exposed to temperatures of over 1400° C. while the exterior, metallic jacket has a temperature normally ranging from about 50° C. to 150° C.

In addition to high stresses resulting from wide variations in temperature, the interior of a blast furnace stove shell is subjected to corrosive action of acids derived from nitrogen-containing oxide and sulfur-containing oxide gases formed during the period of combustion. Such gases include nitrous oxide ($N_2O$), nitric oxide (NO), nitrogen dioxide ($NO_2$) and nitrogen tetroxide ($N_2O_4$), all of which are generally designated as "$NO_x$" gases. These gases may combine with water vapor formed by combustion in the first phase heating period or with water condensate formed on cooler areas of the stove walls, to form nitrous acid or nitric acid. Similarly, gases such as $SO_2$ and $SO_3$ may form sulfurous or sulfuric acids within the stove. It is well known that higher temperatures greatly favor the formation of nitrogen-containing oxides. As described in a recent German publication [*Stahl and Eisen,* 97(13), 633–637, (1977)], the highest concentrations of nitrogen-containing oxides develop during the bottled phase.

Metallic portions of stove walls are especially susceptible to attack from these $NO_x$-derived corrosive acids. For example, the refractory lining of a stove is not typically gas tight, so that nitrogen-containing gaseous oxides can penetrate to the metallic jacket and react with water contained in the combustion gas or condensate found upon the jacket inner surface to form the aforementioned corrosive acids. Within portions of the metallic jacket where intercrystalline stresses are high, such as at seams, bends, creases, or weld points, the corrosive action of acids may be accelerated and may lead to cracking of the jacket. This phenomenon, known as "stress corrosion cracking", may require operation of the stove at reduced pressures and temperatures, and may cause ultimate structural failure of the stove jacket.

There are several blast furnace stove constructions known which are directed toward minimizing stress corrosion cracking. In U.S. Pat. No. 4,003,695 to Kandakov, for example, the inner surface of the stove metallic jacket may be coated with acid-resistant paints or gunite materials, or coated with "shotcrete" applied mortar-like compounds. The jacket, itself, may be fabricated of corrosion-resistant steel or layered with a foil of corrosion-resistant material. Other constructions utilize alternating layers of insulating materials and corrugated sheets to isolate the metallic jacket from the gaseous composition of a bottled stove.

All of these constructions suffer from reliability problems inasmuch as protection of the metallic jacket from the corrosive effects of the gaseous composition depends upon attaining gas-tight seals. Moreover, these complicated wall constructions are costly to fabricate for new stoves and are very difficult to install on existing stoves. Over a period of time, repeated cycles of large temperature variations cause differential contraction and expansion of stove wall components which result in overheating of bonding materials or coatings, or cracking of metal foil linings. Ultimately, the integrity of a gas-tight seal of even the more costly wall construction is lost.

There remains a need, therefore, for improved constructions and methods of blast furnace stove operation which alleviate conditions for stress corrosion cracking and which provide high reliability over the useful life of a blast furnace stove.

SUMMARY OF THE INVENTION

Conditions tending to promote stress corrosion cracking in metallic portions of a high-temperature regenerative air heater may be or alleviated by methods which include the step of storing within the heater a gas composition substantially devoid of free oxygen, during a period of time that the regenerative air heater is between its heat-absorbing and heat delivering modes of operation. The phrase "substantially devoid of free oxygen" describes a gas composition having virtually no free oxygen or having oxygen in an amount which, at the temperatures of air heater operation, is sufficiently small such that nitrogen-oxide formation occurs in such low amounts that stress-corrosion cracking is alleviated in the metallic shell of the regenerative air heater. A particular, maximum amount of free oxygen which may be tolerated in a gas composition, without significant nitrogen-oxide formation, will depend upon several factors, including temperature and pressure conditions within the heater, type and amount of other components of the gas composition and length of time the gas composition is stored in the air heater. The term "free oxygen" embraces diatomic oxygen ($O_2$), nascent oxygen (O) and ozone ($O_3$).

Storing the gas composition, or charge of gas, within the air heater between heat-transfer modes of operation is accomplished preferably by purging, the heater, that is, introducing a flow of gas into the regenerative air heater, which purging gas is substantially devoid of free oxygen, just after heat is extracted by a heat-storage member from a heat-surrendering gas stream. This purging flow of gas may be provided by a source of combustion-product gas, or by a source of nitrogen or other inert gas, or by a mixture of these gases.

A high-temperature regenerative air heater to which the invention is particularly suitable is a blast furnace stove utilized to provide blast air in a blast furnace iron-making operation. In a blast furnace operation utilizing three or more stoves in parallel arrangement, the charge of gas substantially devoid of free oxygen which is stored in a bottled stove may be provided by a flow of combustion product gas drawn from a companion stove operating in the on-gas phase of the three-phase cycle of stove operation. Combustion product gas streams may be supplemented by nitrogen or other inert gas.

In another embodiment, the charge of gas for storing in the bottled stove may be provided by retaining in the stove a portion of the gaseous combustion product composition formed during the stove on-gas phase.

Generally, the gas charge for storing within the high-temperature regenerative air heater, or blast furnace stove, will contain free oxygen at a concentration no greater than 3.5 volume percent.

An advantage of using the method of the present invention is that, in storing within a stove a gas substantially devoid of oxygen, gases like nitrogen- and sulfur-containing oxides are less likely to be formed. In the absence of these gases, there is consequently formation of lesser amounts of corrosive compounds such as nitrous, nitric, sulfurous and sulfuric acids. Thus the conditions which promote stress corrosion cracking of metallic portions of the stove are substantially alleviated. For blast furnace stoves in particular, the absence of these corrosive acids precludes the need for complicated and expensive wall constructions to provide gas-tight isolation of the metallic jacket from the stove gaseous contents.

The methods of the present invention have not been utilized in prior, conventional blast furnace stoves. Stress corrosion cracking of the stove interior wall is a common problem in conventional high temperature blast furnace stoves when the stoves are placed in the bottled condition with a gas charge containing a significant amount of atmospheric air. In some operations, blast furnace stoves are bottled under pressure with atmospheric air as the pressurizing gas. In either of these conventional operations,

BRIEF DESCRIPTION OF THE DRAWINGS

In the drawings which form part of a description of an illustrative embodiment of the present invention, and wherein like reference numbers refer to the like structural elements.

DESCRIPTION OF A PREFERRED EMBODIMENT

The advantages and benefits of the present invention are attendant to application of the disclosed methods to practically any high-temperature regenerative air heater. For convenience, however, further detailed discussion of the invention will be directed to description of a specific regenerative heater, namely, a blast furnace stove as utilized in an iron-making blast furnace operation. Certain definitions, as used in this description, may apply to regenerative air heaters generally, as well as to blast furnace stoves.

Figure 1:
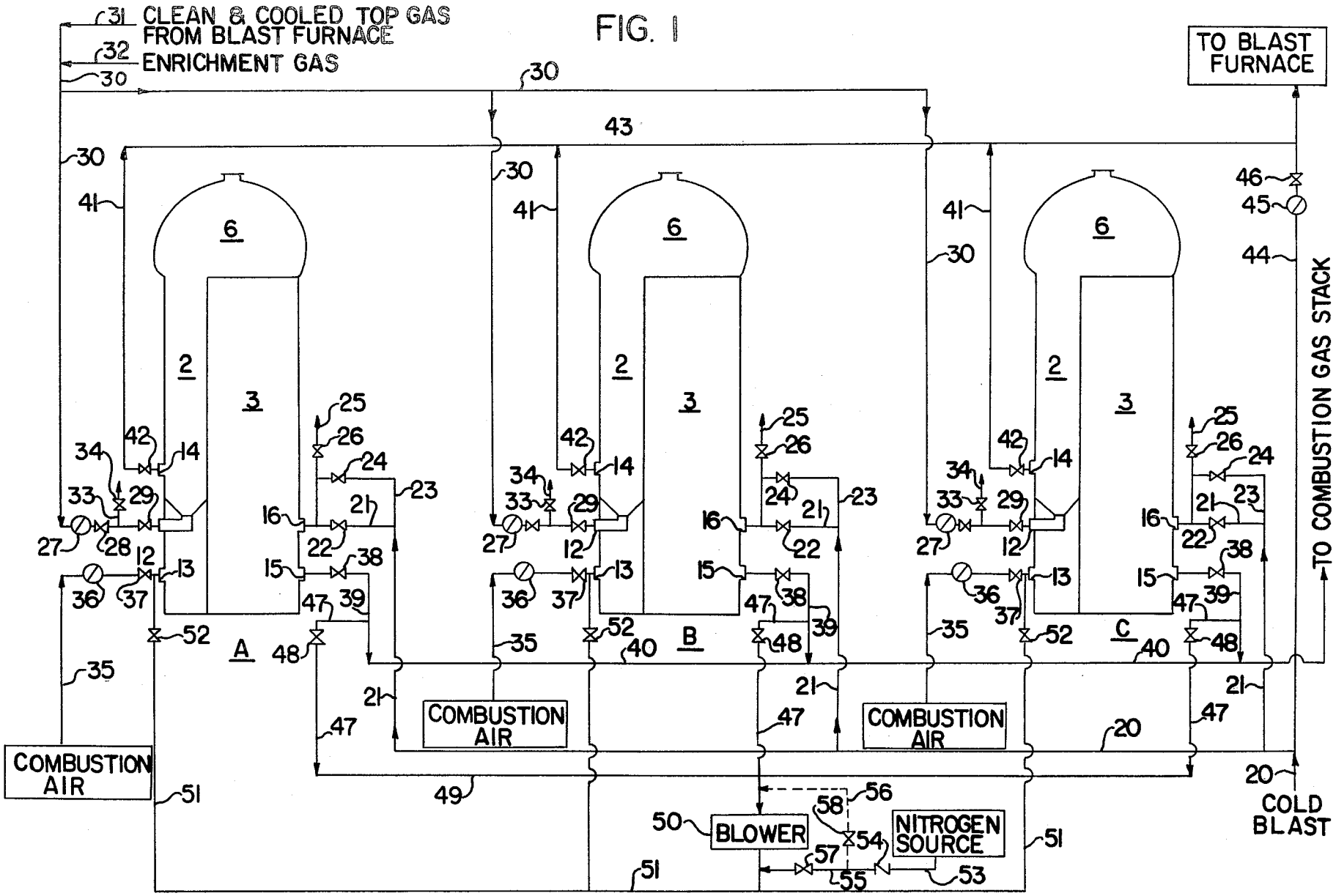
FIG. 1 is a flow diagram showing schematically the interconnection of a bank of blast furnace stoves for furnishing blast air to a blast furnace.
Figure 2:
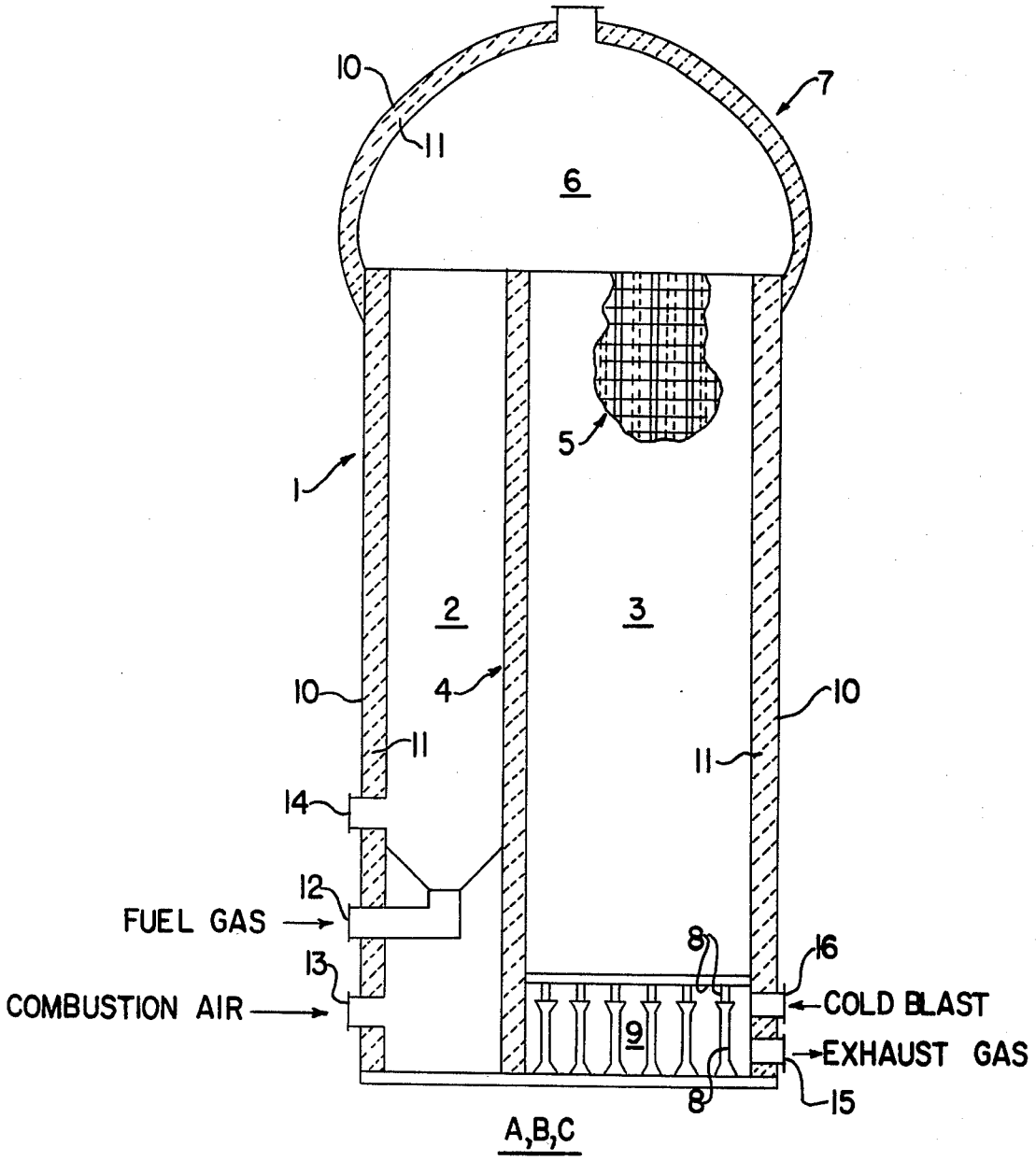
FIG. 2 is a vertical section of a side elevational view of a blast furnace stove.

Depicted in FIG. 1 is a schematic representation of components included in a typical blast furnace stove operation for furnishing blast air to a blast furnace (not shown), those components comprising a bank of blast furnace stoves A, B and C. As shown in FIG. 2, each of stoves A, B and C has a cylindrical side wall 1 which defines an interior comprising two vertically-oriented passageways 2 and 3 separated by a breastwall 4. Passageway 2 provides a chamber within which combustion takes place, while passageway 3 contains a heat exchanger structure in the form of ceramic checkerwork 5 comprising a series of interconnected passageways. The upper ends of passageways 2 and 3 are in communication with a head space 6 defined by a dome 7. At the bottom of passageway 3, checkerwork 5 is supported by foundation member 8 comprising an assembly of columns, girders and grids which provide a passageway 9 beneath checkerwork 5.

Cylindrical side wall 1 and dome 7 are comprised of an outer, metallic jacket 10 and inner insulator lining 11. Metallic jacket 10 is typically fabricated of fine-grain carbon steel, such as ASTM A516 Grade 60, and typically has a thickness from about 0.5 to about 1.5 inches, depending upon operation pressure and temperature, and dimensions of the stove. Insulator lining 11 is typically fabricated of block-like refractory material stacked in a layered configuration. Examples of suitable refractory materials include fireclay, alumina and silica brick. Breastwall 4, as well as the walls defining passageways 2 and 3, are typically fabricated of refractory materials.

Passing through stove side wall 1 and into passageway 2 are fuel gas inlet port 12, combustion air inlet port 13 and hot blast outlet port 14. Also passing through stove side wall 1 and in communication with passageway 9 near the base of the stove are ports 15 and 16. Port 15 connects stove passageway 9 to an exhaust gas flue (not shown), while port 16 provides a cold blast inlet.

There is depicted in FIG. 1 an arrangement of stoves A, B and C connected in parallel for feeding blast air to a blast furnace (not shown). A pressurized air source, usually a turbo-type blower, provides a stream of air, or "cold blast", to main air line 20 which then feeds individual cold blast lines 21 of stoves A, B and C. For stove A, as an example, cold blast line 21 is connected to cold blast inlet port 16 through valve 22. A bypass circuit is provided comprising a bypass line 23 which is connected to cold blast feed line 21 ahead of valve 22 and which is then connected through a valve 24 to cold blast feed line 21 on the stove side of line 21. This bypass circuit permits pressurizing a stove prior to placing it in the on-blast mode of operation. Also connected to the stove side of cold blast line 21 is a blow-off line 25 and valve 26, which provide for blowing off the stove after the on-blast mode of operation.

For each of stoves A, B and C, there is connected to fuel gas inlet port 12, through regulator 27 and series of valves 28 and 29, a fuel gas feed line 30. Typically, fuel gas feed line 30 is connected at its origin to a blast furnace top gas feed line 31 and to an enrichment gas line 32. Located between series valves 28 and 29 is a vent line 33 having a safety vent valve 34. Safety vent line 33 and valve 34 are used to vent (1) combustible gases so that they do not enter a stove that contains air but is not pressurized or (2) to vent air so that it does not enter the gas line when the stove is pressurized in the event series valves 28 and 29 become defective. A combustion air line 35 is connected to combustion air inlet port 13 through a metering valve or regulator 36 and a shut-off valve 37.

Connected to exhaust gas port 15 through a shut-off valve 38 is an exhaust gas line 39 terminating in a common header 40 which gathers exhaust from exhaust gas lines 39 from each of stoves A, B and C. Header 40 conveys combustion product gases to a stack (not shown) for disposal. Hot blast feed line 41 of each of stoves A, B and C is connected from hot blast outlet port 14 through valve 42 to hot blast main line 43 which delivers hot blast to the blast furnace. A cold blast feed line 44 connects cold blast main line 20 to hot blast main 43 through a regulator 44 and a valve 46. Cold blast may thereby be supplied to moderate the temperature of hot blast which is fed to a blast furnace through hot blast main line 43.

Shown in FIG. 1, as heavily-inked elements, is an arrangement of gas conduit lines and valves for effecting a preferred embodiment of the process of the invention. This preferred embodiment includes a stove exhaust gas recirculation system to convey stove exhaust gases from exhaust gas line 39, of a stove operating in its on-gas phase, to combustion air inlet port 13, of a stove or stoves to be bottled. The recirculating system comprises an exhaust gas diverter line 47 connected to stove exhaust gas line 39, at the exhaust stack side, and through valve 48 is connected at its other end to header 49. Header 49 is connected to the intake port of a blower 50. Connected at the output of blower 50 is exhaust gas return line 51 which through valves 52 is connected to each of combustion air inlet ports 13 of stoves A, B and C. A nitrogen source is connected to the exhaust gas recirculation system to provide an inert gas which may be used alone or mixed with the stove exhaust gases. Nitrogen feed line 53 is connected through a check valve 54 to high-pressure line 55 and low-pressure line 56. High-pressure line 55 through valve 57 is connected to exhaust gas return line 51 at the output side of blower. Low-pressure line 56 through valve 58 is connected to exhaust gas take-off line 45 at the intake side of blower 50.

In a typical iron-making process utilizing components described in FIGS. 1 and 2, hot blast is delivered continuously to a blast furnace from one or more of stoves A. B. and C. Usually, a blast furnace stove operates in its heating or on-gas phase for about 30 to 60 minutes and operates in its on-blast phase for about 30 minutes, there being a stand-by or bottled condition phase, between the on-gas and on-blast phases, of 20 minutes to an hour, or more.

For the stove heating phase, a mixture of combustible blast furnace waste gas or top gas is collected from the furnace waste gas flue. The furnace top gas is usually mixed with an enriching gas, such as coke-oven gas or natural gas, so as to have a calorific value of between 85 and 100 BTU per standard cubic foot. The enriched top gas is conveyed through fuel gas feed line 30 to gas inlet port of each of stoves A, B and C. When a stove is in its on-gas phase, the enriched top gas and combustion air provided at fuel gas inlet port 12 and air inlet port 13, respectively, are mixed together in the burner at the bottom of the stove combustion chamber within passageway 2. With gas and air flows controllable by regulator valves 27 and 36, respectively, the volume ratio of gas and air is adjusted so that at the beginning of the on-gas phase, air is furnished at approximately a 10 percent volume excess of the stoichiometric amount. At this level of excess combustion air, the exhaust gas will usually contain about 1 to 1.5 volume percent free oxygen during the period of time dome 7 is heated to its normal operating temperature in a range from about 1400° C. to about 1550° C.

In accordance with the methods of the invention, a stove placed in a bottled condition will contain a charge of gas which is substantially devoid of free oxygen. The phrase "substantially devoid of oxygen" is defined above in the general description of the methods of the invention as adapted to a regnerative air heater. For a blast furnace stove in particular, this phrase connotes a gas charge, for storing or holding in a stove, having a concentration of oxygen sufficiently small so that formation of $NO_x$ or $SO_x$ compounds are suppressed to a level to alleviate substantially any acid-induced stress corrosion cracking of stove interior walls. Generally, a gas charge is useful for suppressing $NO_x$ or $SO_x$ formation in a bottled stove if the free oxygen present is less than about 3.5 volume percent of all gases in the gas charge when the stove is bottled at about atmospheric pressure.

The gas charge for storing or maintaining in a bottled stove may be furnished in a number of ways. For example, the gas charge may be provided by retaining within the stove a portion of the combustion product gases formed during the stove on-gas phase. Or, the charge of gas may be provided by purging the stove with a gas substantially devoid of oxygen just prior to bottling the stove. Purging of the stove physically sweeps free-oxygen-containing gases from the stove, or dilutes the stove gaseous contents so as to reduce the presence of oxygen to a desired low concentration. A purging gas can be provided by a source of combustion-product gas, such as a companion stove operating in an on-gas phase, or by a source of nitrogen or other inert gas, or by a combination of these sources.

In the method of purging the stove with a gas substantially devoid of free oxygen just prior to bottling the stove, delivery of the combustion-air and fuel-gas streams is stopped by closing valves 37 and 29, respectively. Then, a purging gas is furnished to the stove through inlet port 13 as controlled by valve 52. It is an important aspect of the invention that the purging gas may be furnished from the product gases formed by a companion stove operating in the on-gas mode of operation. Typically, at least one and perhaps two stoves of a three-stove operation will be running in the on-gas mode so that a sufficient supply of exhaust gas will be available to purge a companion stove to be bottled. Thus, as depicted in FIG. 1, with stoves B or C, or both, operating in the on-gas mode, exhaust gases will be normally discharged from exhaust port 15 to exhaust line 39 for disposal through header 40 to the combustion gas stack. Valve 48 on exhaust gas diverter line 47 may be opened to divert all or a portion of the stove exhaust gas stream to header 49 and then, with assistance from blower 50 to exhaust gas return line 51. Stove A thus has available at inlet port 13 a flow of gas substantially devoid of free oxygen. The flow of gas into stove inlet port 13 may be controlled the blower or by valve 52. The flow of purging gas is supplied to stove A for a period of time sufficient to reduce the concentration of oxygen to less than about 3.5 volume percent. During the purging step, purged gas may be removed from stove A through exhaust gas port 15 and vented to the combustion gas stack by way of line 39 and header 40. After free oxygen is removed substantially from the stove gas charge, inlet valve 13 and all other stove port valves are closed for storing the gas charge in the stove during its bottled mode.

As another embodiment of the invention, as illustrated in FIG. 1, a purging gas may be provided to a stove from a nitrogen source. If the nitrogen source is pressurized, then nitrogen may be supplied through feed line 53 directly into purging gas return line 51 by way of high-pressure line 55 and valve 57. If the nitrogen source is not pressurized, then nitrogen may be introduced or bled into header 49 from notrogen feed line 53 and check valve 54 through line 56 and valve 58 at the intake of blower 50. Thus, blower 50 may be utilized to assist delivery of nitrogen gas to stove A. Practically any inert gas may be used in place of nitrogen as a purging gas. Also, a purging gas may comprise a mixture of nitrogen and exhaust gas from a stove operating in the on-gas mode. Such mixture may be formed by introducing nitrogen from a pressurized source through line 55 and valve 57 into purging gas return line 51, while stove exhaust gas is also conveyed through purging gas line 51. Or, nitrogen from a non-pressurized source may be bled into and mixed with a stream of exhaust gas at the intake of blower 50.

Along with reduction in nitrogen-containing oxides by utilization of the described methods of the invention, there typically occurs reduction of sulfur-containing oxide gases as well. The benefits of reduction of $SO_x$ gases may be enhanced by other additional steps, such as treatment of the fuel gas which is utilized for the on-gas mode of stove operation. For example, an enrichment gas containing little or no sulfur, such as provided by desulfurized coke oven gas or natural gas, can be used for mixing with and enriching furnace top gas to be supplied as fuel gas to the ovens through fuel gas line 30. Or, combustion air delivered through air line 35 can be preheated to eliminate need for an enrichment gas.

It is expected that the reduction of nitrogen-containing oxides ($NO_x$) and sulfur-containing oxides ($SO_x$) in a bottled stove can be accomplished by bottling the stove with a gas charge furnished from products of combustion (POC) derived from operating a companion stove in the on-gas mode. Along with a reduction in the $NO_x$ and $SO_x$ gases, there should be a reduction in derivative corrosive acids, thereby alleviating stress corrosion cracking of stove metallic wall portions, especially in the dome interior wall. It is these combined $NO_x$ and $SO_x$ gases which form and then diffuse through the refractory material to the metallic shell when the stove is bottled. The diffusion increases when the stove is pressurized or is put on blast. For example, as stove gases cool in diffusing toward the stove shell, the lower temperature combined with higher pressure favor the formation of nitrogen dioxide according to the reaction:

$$NO+\tfrac{1}{2}O_2 \rightarrow NO_2$$

The nitrogen dioxide in turn can combine with water formed during fuel combustion that condenses on the shell to form nitrous and nitric acids according to the following reaction:

$$2NO_2+H_2O \rightarrow HNO_2+HNO_3$$

It is an object of this invention to provide conditions, as described above which will minimize formation of such acids.

The form of the invention described in detail herein is a preferred embodiment. It is understood, however, that changes may be made without departing from the gist of the present invention defined by the following claims.

What is claimed is:

1. A method for reducing stress-corrosion cracking in metallic interior portions of a high-temperature regenerative air heater operating in heat-transferring modes comprising alternately extracting heat from a heat-surrendering gas stream and delivering heat to a heat-absorbing air stream, the method comprising:

storing within a heated regenerative air heater a gas charge substantially devoid of free oxygen, during a period of time between heat transferring modes, whereby the concentration of nitrogen-containing oxides is maintained at a level sufficient to alleviate stress-corrosion cracking in the metallic interior portions of the regenerative air heater.

2. The method of claim 1 wherein the gas charge for storing within the regenerative air heater is provided by a flow of gas which is used for purging the air heater and which is substantially devoid of free oxygen just after heat is extracted from a heat-surrendering gas stream.

3. The method of claim 2 wherein the flow of gas is provided by a source of combustion product gas.

4. The method of claim 2 wherein the flow of gas is provided by a source of nitrogen or other inert gas.

5. The method of claim 2 wherein the flow of gas is provided by a gas stream from a source of combustion product gas, to which gas stream there is mixed nitrogen or other inert gas.

6. The method of claim 1 wherein the gas charge stored during said period of time contains free oxygen at a concentration no greater than 3.5 mole percent of all components of the gas composition.

7. A process for providing blast air for delivery to a blast furnace, the blast air formed by heating air in one or more stoves, each stove of a type having an interior which includes a combustion chamber and heat storage means, the process comprising the steps of:

(a) burning a mixture of gases provided by a stream of fuel gas and a stream of air introduced to the stove combustion chamber, which mixture in burning produces gaseous combustion products which fill the interior of the stove, which gaseous combustion products are substantially devoid of free oxygen;

(b) storing a charge of gas within the interior of the stove when the stove is in a bottled condition, the gas charge being substantially devoid of free oxygen.

whereby high-temperature blast air may be delivered from a stove previously-bottled under conditions which substantially alleviate stress corrosion cracking of the metalic shell of the stove.

8. The process of claim 7 further comprising the step of introducing a flow of gas which is substantially devoid of free oxygen into the stove to be bottled prior to placing the stove in a bottled condition so as to provide the charge of gas for storing in the bottled stove.

9. The process of claim 8 wherein the flow of gas is provided by a source of combustion product gas.

10. The process of claim 9 wherein the source of combustion product gas is a blast furnace stove, other than the stove to be bottled, which is burning a mixture of fuel, gas and air.

11. The process of claim 8 wherein the flow of gas is provided by a source of nitrogen or other inert gas.

12. The process of claim 8 wherein the flow of gas is provided by a gas stream from a source of combustion product gas, to which gas stream there is mixed nitrogen or other inert gas.

13. The process of claim 8 wherein the flow of gas is introduced into the stove by steam injector means, or gas compressor means.

14. The process of claim 7 wherein the charge of gas stored in the bottled stove contains free oxygen at a concentration no greater than 3.5 volume percent.

15. The process of claim 7 wherein the charge of gas stored in the bottled stove is provided by a further step of retaining in the stove a portion of the gaseous combustion products formed in step (a).

16. A method for reducing stress-corrosion cracking in a blast furnace stove, where at least three of such stoves are connected in a parallel arrangement for providing blast substantially continuously to a blast furnace, wherein when each of the stoves operates in a three-phase cycle with a first stove in an on-gas phase, a second stove in a bottled phase and a third stove in an on-blast phase, the method comprising:

storing within a stove in the bottled phase a charge of gas substantially devoid of free oxygen so as to reduce formation of nitrogen-containing oxides.

17. The method of claim 16 wherein the charge of gas for maintaining within a bottled stove is provided by a flow of gas which is used for purging the stove and which is substantially devoid of free oxygen.

18. The method of claim 17 wherein the flow of gas is provided by a source of combustion product gas.

19. The method of claim 18 wherein the source of combustion product gas is a blast furnace stove, other than the stove to be bottled, which is burning a mixture of blast furnace gas and air.

20. The method of claim 17 wherein the flow of gas is provided by a source of nitrogen or other inert gas.

21. The method of claim 17 wherein the flow of gas is provided by a gas stream from a source of combustion gas, to which gas stream there is mixed nitrogen or other inert gas.

22. The method of claim 17 wherein the flow of gas is introduced into the stove by steam injector means.

23. The method of claim 16 wherein the charge of gas maintained in the bottled stove contains free oxygen, a concentration no greater than 3.5 volume percent.

* * * * *